US005765268A

United States Patent [19]

MacKirdy

[11] Patent Number: 5,765,268

[45] Date of Patent: Jun. 16, 1998

[54] CASKET LID SUPPORT

[75] Inventor: William T. MacKirdy, Scott Run, Pa.

[73] Assignee: Casket Shells, Incorporated, Pa.

[21] Appl. No.: 827,258

[22] Filed: Mar. 28, 1997

[51] Int. Cl.[6] ..... A61G 17/02

[52] U.S. Cl. ..... 27/18; 217/60 D; 292/338

[58] Field of Search ..... 27/14, 18; 220/264, 220/335, 326; 217/60 D, 60 R, 60 B; 292/338

[56] References Cited

U.S. PATENT DOCUMENTS

| | | | |
|---|---|---|---|
| 1,119,892 | 12/1914 | Socin | 217/60 D |
| 2,550,008 | 4/1951 | Freeman | 292/338 |
| 2,593,312 | 4/1952 | Joseph | 217/60 D |
| 2,723,776 | 11/1955 | Jacobson | 292/338 |
| 2,842,278 | 7/1958 | Murphy | 292/338 |
| 2,848,783 | 8/1958 | Keller, Jr. et al. | 27/18 |
| 3,959,859 | 6/1976 | Stein, Jr. et al. | 27/18 |
| 4,239,093 | 12/1980 | Eubanks et al. | 220/335 X |

*Primary Examiner*—Kien T. Nguyen

*Attorney, Agent, or Firm*—Kane, Dalsimer, Sullivan, Kurucz, Levy, Eisele and Richard, LLP

[57] ABSTRACT

A lid support releasably locks a casket lid in an open position relative to a casket body. A curved arm with a curved slot is pivotably connected at one end to the lid and the other end having a circular opening at the adjacent end of the slot. A follower has a stem disposed in the slot and is movable therein as the lid is moved between its open and closed position. A tubular boss coupled with the stem is adapted to enter the circular opening under the influence of a spring to releasably lock the lid in its open position. Upon depressing the stem against the bias of the spring, the boss is adapted to be withdrawn from the opening and the stem is adapted to enter the slot to permit the lid to be moved to its closed position.

10 Claims, 2 Drawing Sheets

CASKET LID SUPPORT

BACKGROUND OF THE INVENTION

Lids of caskets are raised and maintained in an open substantially vertical position for viewing of the deceased. Lids are normally large, cumbersome, difficult to manipulate and quite heavy, and heretofore, a variety of lid supports have been proposed and utilized. However, these lid supports have been not been entirely satisfactory in locking the casket lid in its open position. Experience has proven that the open casket lids could and would be readily pivoted in either direction relative to the casket body from its releasably locked position which occurrence would not be desirable. Moreover, the prior art lid supports have not been rugged in construction because the lid support had to be small in size not only for aesthetic purposes but to assume proper sealing or seating of the casket lid when in the closed position. An example of a prior art lid support appears in U.S. Pat. No. 3,959,859.

SUMMARY OF THE INVENTION

A principal object of the present invention is to provide a casket lid support which alleviates the problems and disadvantages of the prior art lid support.

Another object is to provide a casket lid support that is simple in construction, positive in locking the lid in its open position and against undesirable pivotal movement in either direction and is aesthetically acceptable.

Other objects and advantages will become apparent from the following detailed description which is to be taken in conjunction with the accompanying drawings.

DETAILED DESCRIPTION

Figure 1:
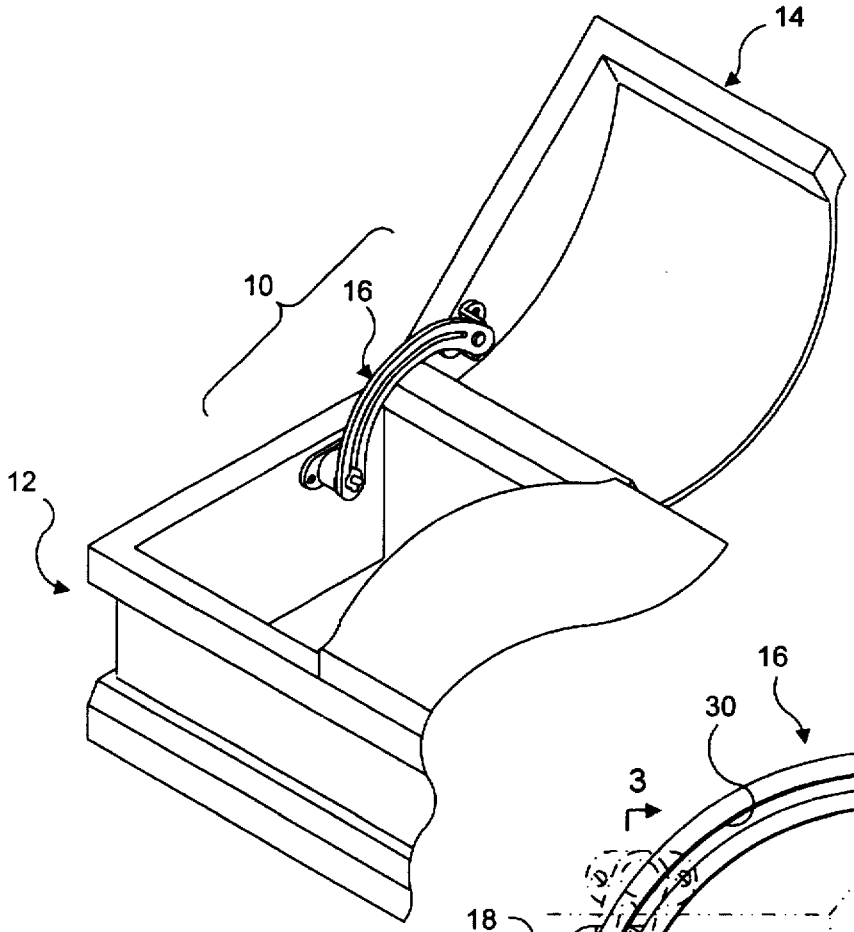
FIG. 1 is a perspective view of a conventional perfection casket with its lid in an open position and releasably locked therein by a lid support of this invention, with certain parts of the casket broken away and removed.
Figure 2:
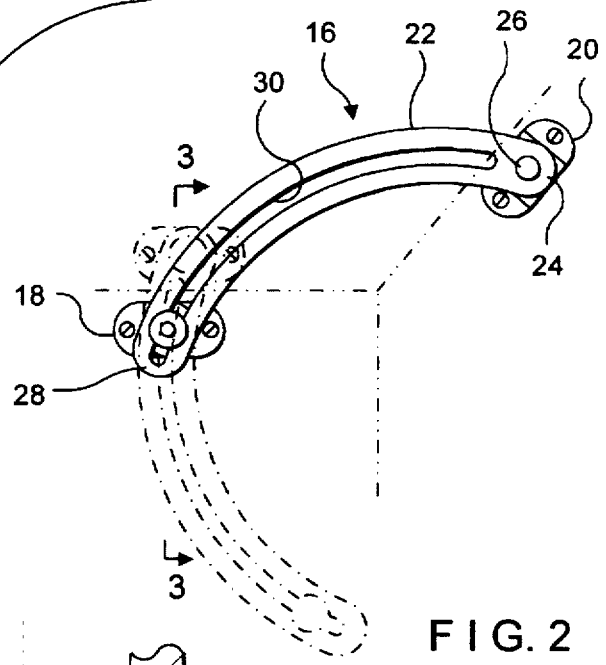
FIG. 2 is an enlarged side elevational view of the lid support of this invention shown in the lid open position with the lid closed position of the lid support shown in phantom.
Figure 3:
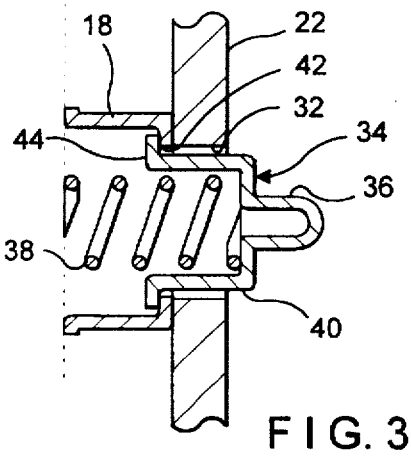
FIG. 3 is a further enlarged fragmentary sectional view taken along the line 3—3 of FIG. 2 showing the lid support in its locked position.
Figure 4:
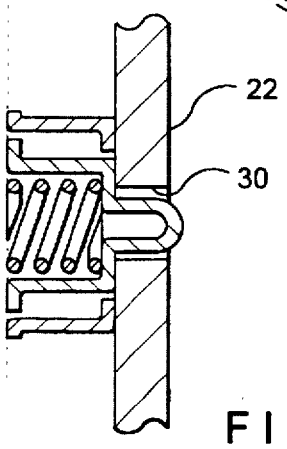
FIG. 4 is a similar sectional view with the lid support in its released position at which the lid is free to be pivoted to its closed or open position.

In FIGS. 1–4 of the drawings, a casket 10 is shown with a body 12 and pivotal lid 14. A lid support 16 of this invention releasably locks the lid 14 in its open position for viewing the deceased.

The lid support 16 includes a bracket 18 secured to the casket body end 20 and a bracket 20 secured to the lid 14 as shown. A curved flat arm 22 is pivotally connected at one end 24 to bracket 20 by any suitable means 26. The other end 28 is free to move relative to bracket 18. In this regard, the arm 22 is formed with a curved slot 30 of uniform width with a section near the end 28 being enlarged to a circular opening 32. Associated with bracket 18 is a follower 34 having a reduced diameter tubular stem or tip 36 that is adapted to ride in and follow the slot 30 against the bias of compression spring 38. The follower 34 includes a tubular boss 40 of increased diameter slightly smaller than opening 32 but not capable of entering slot 30. However, the boss 40 is sized to extend through opening 42 in bracket 18 and also to enter opening 32 under the influence of spring 38. Radial flange 44 at the base of the boss 40 secures the follower 34 to the bracket 18 and keeps it associated therewith.

When the lid is closed, stem tip 36 will be disposed in slot 30. Upon raising the lid 14, the stem 36 follows the contour of slot 30 until the boss 40 is opposite the opening 32 at which time the spring 38 will urge and force boss 40 to enter the opening 32. The lid is now releasably locked in a fixed open position for viewing. In this position, the lid cannot pivot in either direction. When it is desired to close the lid 14, the stem 36 is pushed inwardly against the bias of the spring 38 thereby enabling stem 36 to enter slot 30. The lid 14 may now be closed.

Figure 5:
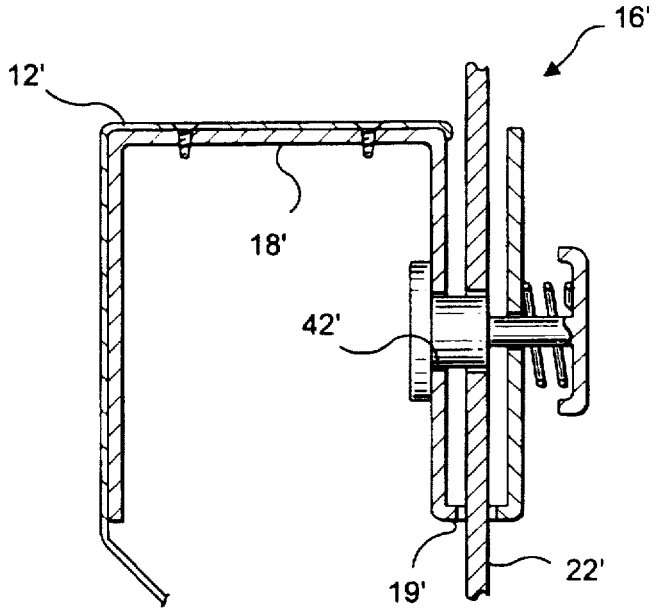
FIG. 5 is a fragmentary sectional view of a preferred embodiment of lid support of this invention shown associated with a casket body shown fragmentarily.
Figure 6:
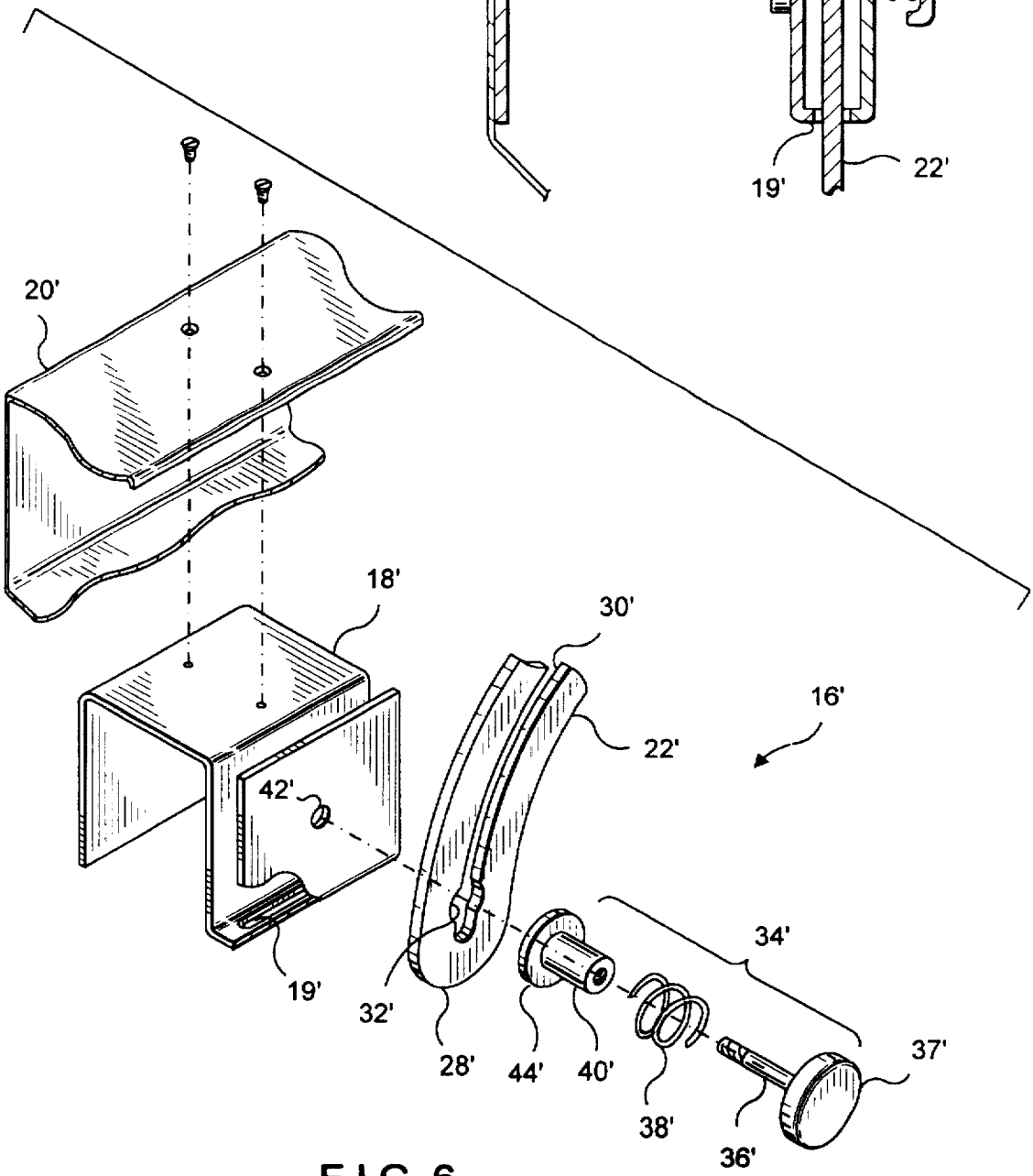
FIG. 6 is an exploded perspective view of the preferred embodiment of lid support with certain parts broken away and removed.

Referring to the preferred embodiment of lid support 16' shown in FIGS. 5 and 6, a bracket 18' of novel configuration is secured to the casket body end 20' as shown by screws or threaded bolts, for example. The bracket 18' is formed with a slot 19' for receiving curved flat arm 22' pivotally connected above end to the casket lid in any suitable, such as shown in the previous embodiments, FIGS. 1–4. The other end 28' is free to move relative to bracket 18' in slot 19'. As in the previous embodiment, the arm 22' is formed with a curved slot 30' of uniform width with a section near the end 28' being enlarged to a circular opening 32'. A follower 34' having a reduced diameter stem 36' that is adapted to ride in and follow the slot 30' against the bias of the compression spring 38'. The outer end of stem 36' includes finger engaging button 37' while the inner end is threadedly connected to tubular boss 40' of increased diameter slightly less than opening 32' but not capable of entering slot 30'. The boss 40' is sized to extend through opening 42' is bracket 18' and enter opening 32' under the influence of spring 38'. Radial flange 44' at the base of boss 40 engages with inner surfaces of the bracket adjacent opening 42' and remains associated with these surfaces by spring 38'.

As in the previous embodiment, when the lid is closed, the stem 36' will be disposed in slot 30'. Upon raising the lid, the stem 36' follows the contour of slot 30' until the boss 40' is opposite the opening 32' at which time the spring 38' will urge and force boss 40' to enter the opening 32'. The lid is now releasably locked in a fixed open position for viewing, and, in this position, the lid cannot pivot in either direction. When it is desired to close the lid, the stem is pushed inwardly by digitally pushing the button 37' against the bias of the spring 38' thereby enabling the stem 36 to enter slot 30'. The lid may now be closed.

Thus, the several aforenoted objects and advantages are most effectively attained. Although several embodiments have been disclosed and described in detail herein, it should be understood that this invention is in no sense limited thereby and its scope is to be determined by that of the appended claims.

I claim:

1. A lid support for releasably locking a casket lid in an open position relative to a casket body, the lid support comprising a first means for coupling with the casket lid, a second means for coupling with the casket body, an arm having one end pivotally connected to one of the means and another end movable relative to the other means, the arm including an elongated slot having an enlarged opening near the another end of the arm, a follower having a stem for being disposed in the slot and movable therein as the lid is moved between its open and closed position, a boss of a size sufficient to be disposed in the opening to releasably lock the lid in its open position, and biasing means for urging the follower boss into the opening when it is aligned therewith, and upon depressing the stem against the biasing means the boss is adapted to be withdrawn from the opening and the stem is adapted to enter the slot to permit the lid to be moved to its closed position.

2. The invention in accordance with claim 1 wherein the second means is a bracket and follower is movably secured to the bracket.

3. The invention in accordance with claim 2 wherein the follower has a tubular stem and tubular boss and the opening is circular.

4. The invention in accordance with claim 3 wherein the arm is curved and the slot is curved.

5. The invention in accordance with claim 1 wherein the lid support adapted to form part of a casket having the lid and the body, the first means pivotally adapted to couple the arm to the lid and the second means is a second bracket adapted to couple with the body, and having a stop, the curved arm being movable in the slot of the bracket.

6. The invention in accordance with claim 5 wherein the biasing means is a spring biasing the follower against the arm.

7. The invention in accordance with claim 6 wherein the follower has a tubular stem and tubular boss and the opening is circular.

8. The invention in accordance with claim 7 wherein the arm is curved and the arm slot is curved.

9. The invention in accordance with claim 8 wherein a radial flange is on the boss for engaging the bracket adjacent the opening.

10. The invention in accordance with claim 9 wherein a finger engaging button is on the stem for pushing the stem in the arm slot relative to the arm and against the bias of the spring.

* * * * *